US007156165B2

(12) United States Patent
Ohata et al.

(10) Patent No.: US 7,156,165 B2
(45) Date of Patent: Jan. 2, 2007

(54) TANK FOR HEAT EXCHANGER

(75) Inventors: Hajime Ohata, Konan (JP); Muneo Sakurada, Konan (JP); Yoshihisa Eto, Konan (JP); Naoto Takayanagi, Konan (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 63 days.

(21) Appl. No.: 10/531,445

(22) PCT Filed: Nov. 12, 2003

(86) PCT No.: PCT/JP03/14340

§ 371 (c)(1),
(2), (4) Date: Apr. 14, 2005

(87) PCT Pub. No.: WO2004/046633

PCT Pub. Date: Jun. 3, 2004

(65) Prior Publication Data

US 2006/0086489 A1 Apr. 27, 2006

(30) Foreign Application Priority Data

Nov. 15, 2002 (JP) ..... 2002-332457

(51) Int. Cl.
*F28F 9/02* (2006.01)

(52) U.S. Cl. ..... 165/176; 165/144

(58) Field of Classification Search ..... 165/144, 165/153, 174, 176

See application file for complete search history.

(56) References Cited

U.S. PATENT DOCUMENTS

| | | | | |
|---|---|---|---|---|
| 5,042,578 | A * | 8/1991 | Tanabe | 165/174 |
| 5,123,483 | A * | 6/1992 | Tokutake et al. | 165/176 |
| 5,125,454 | A * | 6/1992 | Creamer et al. | 165/173 |
| 5,207,738 | A * | 5/1993 | Dey | 165/175 |
| 5,743,329 | A * | 4/1998 | Damsohn et al. | 165/174 |
| 5,842,515 | A * | 12/1998 | Kim | 165/175 |
| 6,289,980 | B1 * | 9/2001 | Insalaco et al. | 165/174 |

FOREIGN PATENT DOCUMENTS

| | | |
|---|---|---|
| JP | 3-128261 | 12/1991 |
| JP | 5-318097 | 12/1993 |
| JP | 11-287587 | 10/1999 |
| JP | 2001-235296 | 8/2001 |
| JP | 2002-031495 | 1/2002 |
| JP | 2002-071283 | 3/2002 |

* cited by examiner

*Primary Examiner*—Teresa J. Walberg
(74) *Attorney, Agent, or Firm*—Wenderoth, Lind & Ponack, L.L.P.

(57) ABSTRACT

In tubular portion of a tank, slits are formed in each side face of chambers or across all side faces of the chambers. For partition plates that are to be inserted from the slits, groove portions in which the partition plates are fitted are formed by cutting portions to which the partition plates butt. The slits are formed in the chambers at positions relatively shifted from each other in a direction in which tubes are layered. This structure guarantees that, in the tank for a heat exchanger, bypass leakage of a heat exchange medium between sub-chambers is prevented from occurring when the partition plates are inserted in the tank from the slits provided on the tank side faces. Further, the tank can maintain required strength even if the slits are formed in it.

4 Claims, 9 Drawing Sheets

(a)

(b)

TANK FOR HEAT EXCHANGER

This application is a U.S. National Phase Application under 35 USC 371 of International Application PCT/JP2003/014340 filed on Nov. 12, 2003.

TECHNICAL FIELD

The present invention relates to a tank used in, for instance, an evaporator of a freezing cycle in an on-vehicle air-conditioning system, and more specifically, it relates to the structure of a tank formed as a component separate from the heat exchanging tubes.

BACKGROUND ART

There are heat exchangers known in the related art achieved with a heat exchange medium flowing through at least four passes and having a tank provided as a component separate from tubes, in which any defective bonding of a partitioning portion can be detected with ease (see, for instance, Japanese Unexamined Patent Publication No. H10-19490).

In addition, there is a structure known in the related art adopted in a heat exchanger achieved with a heat exchange medium flowing through at least four passes and having a tank provided as a component separate from tubes, in which two chambers are formed side-by-side along the direction of the air flow by partitioning the tank with a partitioning wall ranging along the direction in which the tubes are layered and each chamber is further divided into sub-chambers with a partition plate inserted through a slit formed at the side face of the tank (see, for instance, Japanese Unexamined Patent Publication No. 2001-74388).

However, the structure of the heat exchanger disclosed in Japanese Unexamined Patent Publication No. H10-19490 needs to be adopted in conjunction with a partitioning portion ranging along the lengthwise direction relative to the tank and formed as an integrated part of the tank through roll forming, and cannot be directly adopted in a heat exchanger in which a partition plate is utilized to form a plurality of sub-chambers by dividing each chamber into a plurality of partitioned chambers along the direction of the air flow, as in the present invention.

The heat exchanger disclosed in Japanese Unexamined Patent Publication No. 2001-74388 poses a problem in that since a single slit extending substantially over the full width of the tank along the air flow direction needs to be formed, the strength of the tank is greatly compromised. In addition, since no slit is formed at the face of the tank at which tube insertion holes are formed, there arises another problem in that a bypass leakage of the heat exchange medium resulting from defective bonding of the partition plate and the tank occurring at this face cannot be detected as a pneumatic leak.

Accordingly, an object of the present invention is to provide a tank for a heat exchanger having a partition plate inserted at the tank through a slit formed at a side face of the tank in order to further partition each of chambers defined with a partitioning wall ranging along the direction in which tubes are layered into sub-chambers formed side-by-side along the layering direction, which assures that bypass leakage of the heat exchange medium is prevented from occurring between the sub-chambers with a high degree of reliability and maintains a required level of strength in the tank even with the slits formed thereat.

DISCLOSURE OF THE INVENTION

In order to achieve the object described above, a tank for a heat exchanger according to the present invention, having a tubular body with the inner space thereof partitioned into a plurality of chambers with a partitioning wall extending along the direction in which heat exchanging tubes are layered and tube insertion holes through which open ends of the heat exchanging tubes are inserted formed at side faces of the individual chambers at the tubular body, is characterized in that a slit is formed over all the surfaces constituting the side faces of each chamber, that the partitioning wall includes a groove portion formed therein at a position corresponding to the position of the slit, at which a partition plate for partitioning the chamber along the length of the tank is fitted, and that each chamber is divided into a plurality of sub-chambers by inserting the partition plate through the slit.

Since the slit through which the partition plate is to be inserted is formed so as to run over all the surfaces constituting the side faces of the chamber, the partition plate achieves a relationship to the tank wall surfaces that allows any bypass leakage of the heat exchange medium occurring between the sub-chambers due to defective bonding to be detected in advance as a pneumatic leak through an inspection conducted by using He or the like. Since the partition plate is fitted at the groove portion of the partitioning wall, bypass leakage of the heat exchange medium over the area where the partitioning wall and the partition plate are connected with each other is prevented. This structure guarantees that any bypass leakage of the heat exchange medium between the sub-chambers can be prevented from occurring with a high degree of reliability.

In order to achieve the object described above, a tank for a heat exchanger according to the present invention, having a tubular body with the inner space thereof partitioned into a plurality of chambers with a partitioning wall extending along the direction in which heat exchanging tubes are layered and tube insertion holes through which open ends of the heat exchanging tubes are inserted formed at side faces of the individual chambers at the tubular body, is characterized in that slits are formed so as to open at side faces ranging along the air flow direction and facing opposite each other among the side faces of each chamber, that groove portions at which a partition plate for partitioning the chamber along the length of the tank is fitted, are formed at the partitioning wall and also at the side face perpendicular to the air flow direction among the side faces at positions corresponding to the positions of the slits and that each chamber is divided into a plurality of sub-chambers by inserting the partition plate through the slits.

Since the slit formed at the side faces of the chamber, through which the partition plate is to be inserted, open at the two side faces ranging along the air flow direction and facing opposite each other among the side faces of the chamber, the partition plate achieves a relationship to the tank wall surfaces that allows any bypass leakage of the heat exchange medium occurring between the sub-chambers due to defective bonding to be detected in advance as a pneumatic leakage through an inspection conducted by using He or the like. In addition, since the partition plate is fitted at the groove portions formed at the partitioning wall and the side face ranging perpendicular to the air flow direction, bypass leakage of the heat exchange medium is prevented from occurring over this area as well. As a result, a highly reliable overall prevention of bypass leakage of the heat exchange medium between the sub-chambers is assured. Furthermore, since the side face ranging perpendicular to the air flow direction is left as a solid wall, the partition plate can be mounted and positioned at the slits with ease to facilitate the process of fitting the partition plate at the tank.

The present invention is further characterized in that the partition plate is constituted with a plate portion for blocking the chamber and an upright portion rising from an end of the plate portion and allowed to come into contact with an edge of a slit.

Alternatively, the partition plate may be constituted with a pair of plate portions for blocking the chamber, a turn portion connecting the insertion-side ends of the plate portions and upright portions rising from the ends of the plate portions on the side opposite from the insertion-side ends and each allowed to come into contact with an edge of a slit, with the turn portion having elasticity so that it springs back in response to a pressing force applied from the outside.

In this case, after the partition plate with the plate portions deformed toward the inside by applying pressure from the outside is inserted, a spring back occurs at the turn portion as the pressure is released, which presses the plate portions in contact with the opening edges of the slit. Leakage of the heat exchange medium is thus minimized. In addition, since the thickness of the plate portions at the partition plate does not need to be set exactly equal to the width of the slit along the air flow direction, the dimensional accuracy of the thickness of the plate portions constituting the partition plate does not need to be controlled rigorously.

The present invention is further characterized in that the slits formed at adjacent chambers are offset from each other along the direction in which the heat exchanging tubes are layered.

In this structure, even if a plurality of slits are formed in the quantity corresponding to the number of chambers with each slit running over all the side faces of the corresponding chamber, the slits are not aligned to form a single straight-line along the direction of the air flow and thus, the tank achieves a relatively high level of strength.

BEST MODE FOR CARRYING OUT THE INVENTION

The following is an explanation of preferred embodiments of the present invention, given in reference to the attached drawings.

Figure 1:
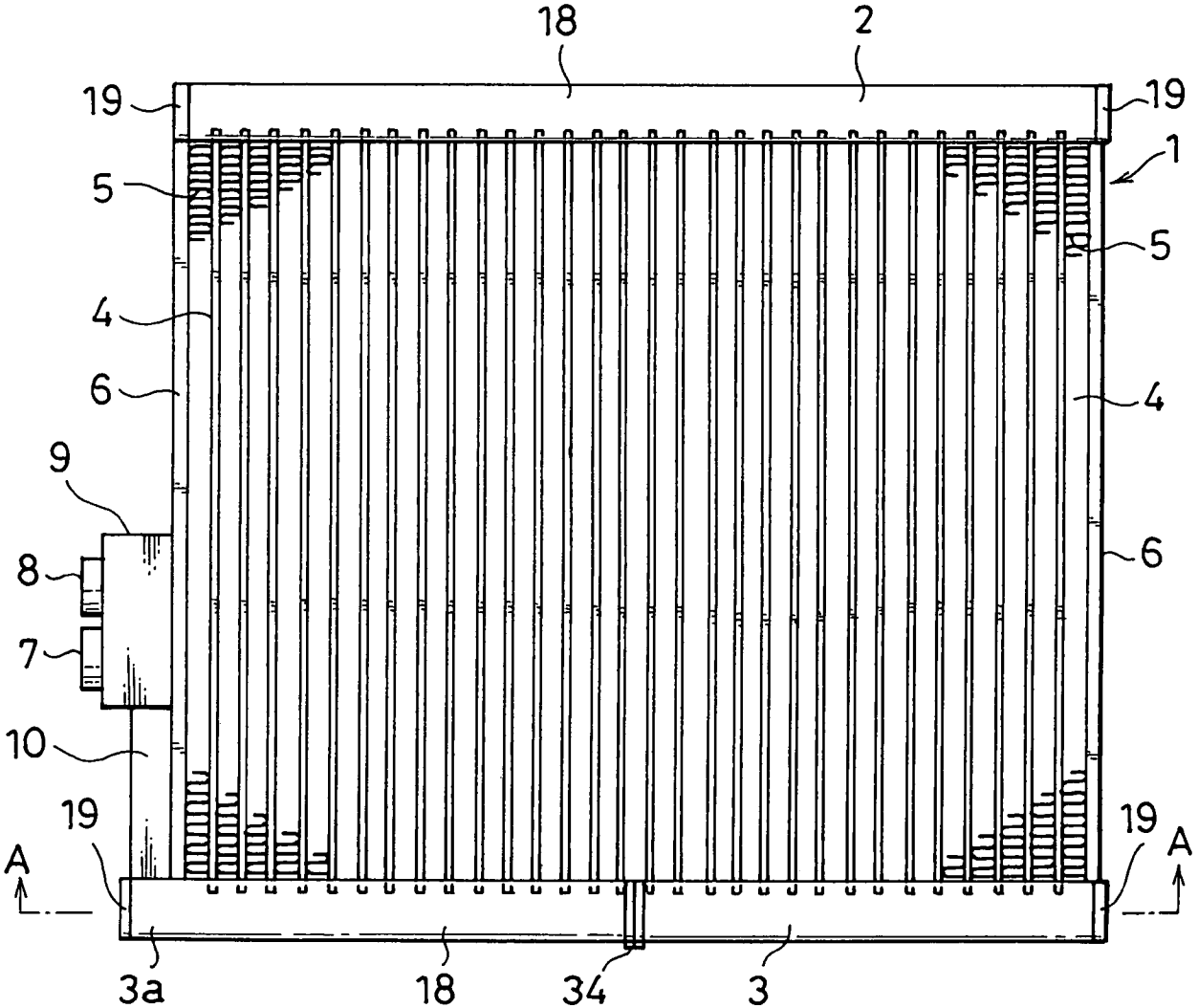
FIG. 1(*a*) is a front view of the overall structure adopted in a heat exchanger having the partitioning members achieved in a first embodiment of the present invention and FIG. 1(*b*) is a side elevation of the overall structure of the heat exchanger, viewed from the heat exchange medium intake/outlet side.
Figure 1:
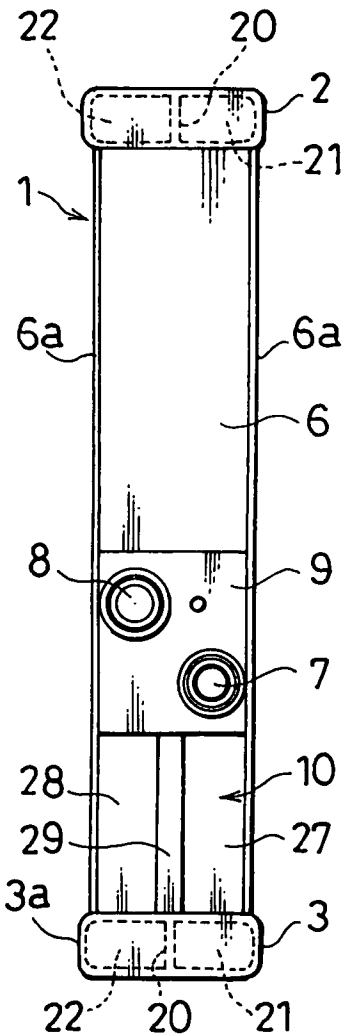
Figure 2:
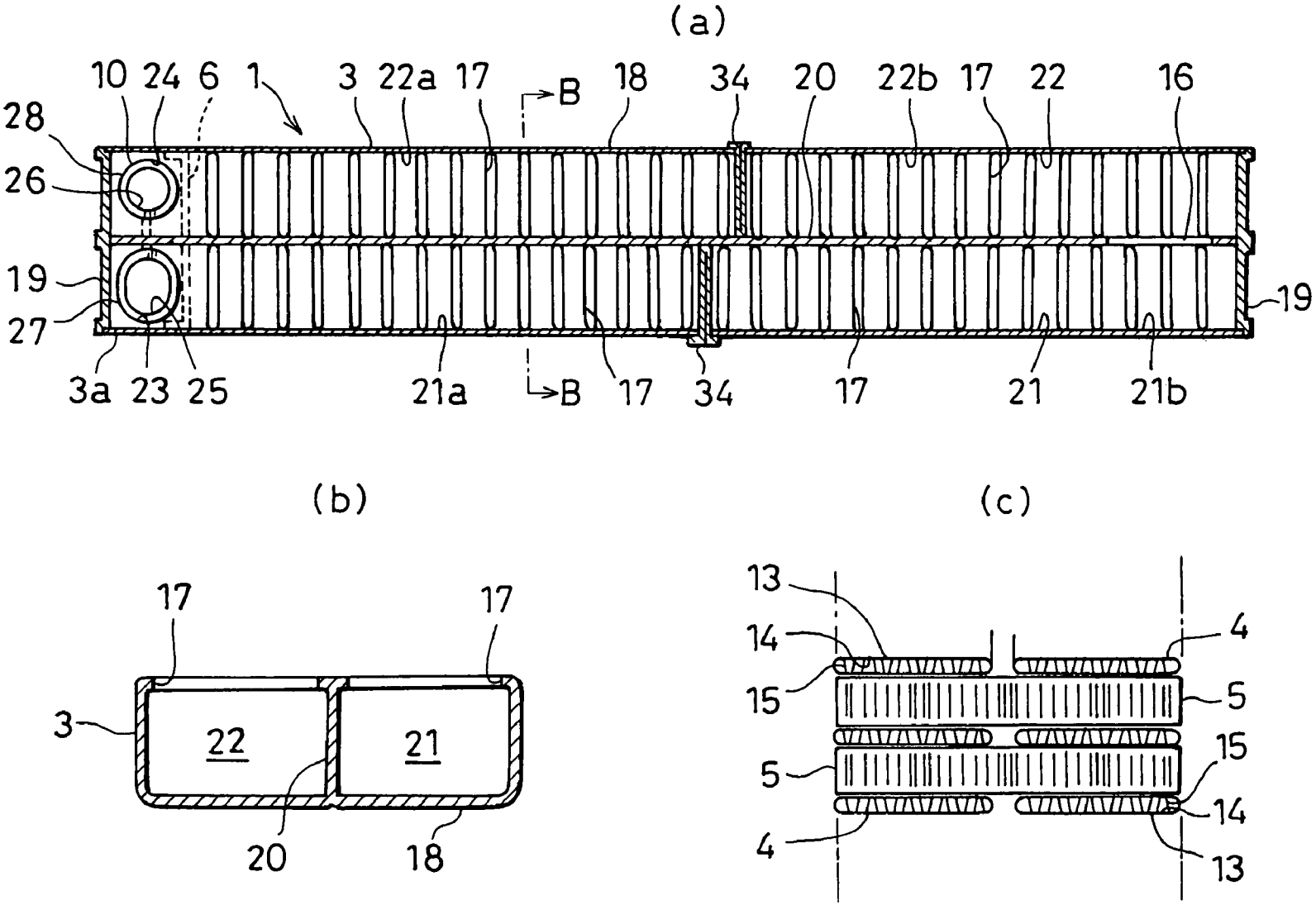
FIG. 2(*a*) is an enlarged sectional view taken along line A—A in FIG. 1, FIG. 2(*b*) is an enlarged sectional view taken along line B—B in FIG. 2(*a*) and FIG. 2(*c*) illustrates the heat exchanging tubes and fins.

A heat exchanger 1 shown in FIGS. 1 and 2 may be used, for instance, as an evaporator constituting part of a freezing cycle of an on-vehicle air-conditioning system. The heat exchanger 1 comprises a pair of tanks 2 and 3, a plurality of heat exchanging tubes 4 communicating between the tanks 2 and 3, corrugated outer fins 5 inserted and bonded between the individual heat exchanging tubes 4, side plates 6 disposed at the two ends of the layered heat exchanging tube assembly and a side tank 10 at which a connector 9 having heat exchange medium intake/outlet portions 7 and 8 is mounted. The connector 9 is connected with an expansion valve (not shown). At the heat exchanger 1, a heat exchange medium supplied through the expansion valve (not shown) flows in via the side tank 10, the heat exchange medium then exchanges heat with the air passing between the outer fins 5 while traveling between the tank 2 and the tank 3 through the heat exchanging tubes 4 and finally the heat exchange medium exits via the side tank 10.

As shown in FIG. 2(*c*), each heat exchanging tube 4 has two open ends at which it is inserted at the tanks 2 and 3 and is formed by housing inner fins 15 inside a flat tube 13 having formed therein a heat exchange medium flow passage 14. In this embodiment, the heat exchanging tubes 4 are each formed by bending a single flat tube material through roll forming.

The tanks 2 and 3 disposed so as to face opposite each other over a predetermined distance are formed so as to range along the direction in which the heat exchanging tubes 4 are layered, and they assume structures substantially identical to each other except that one of them includes a projecting portion 3*a*.

To explain one of the tanks, i.e., the tank 3, in reference to FIGS. 2(*a*) and 2(*b*), the tank 3 is constituted with a tubular body 18 having tube insertion holes 17 at which the heat exchanging tubes 4 are inserted and formed through extrusion molding and a cap 19 that closes off the opening ends of the tubular body 18.

In addition, a partitioning wall 20 ranging along the direction in which the heat exchanging tubes 4 are layered is formed as an integrated part of the tubular body 18 of the tank 3, and thus, the space inside the tank 3 is divided into a chamber 21 and a chamber 22 set side-by-side along the direction of the air flow. As detailed later, the chambers 21 and 22 are further partitioned along the air flow direction into sub-chambers 21*a* and 21*b* and sub-chambers 22*a* and 22*b* respectively. In order to achieve a four-pass heat exchange medium flow, the sub-chamber 21*b* and the sub-chamber 22*b* are made to communicate with each other via a communicating passage 16.

The tank 3 includes the projecting portion 3*a*, which projects further out along the layering direction relative to the heat exchanging tube 4 at the terminating end of the layering. This projecting portion 3*a* is formed by distending the tubular body 18, and the partitioning wall 20 is also allowed to extend to come into contact with the inner side surface of the cap 19. Thus, the chambers 21 and 22 of the tank 3 mentioned earlier are still partitioned from each other inside the projecting portion 3*a*. In the projecting portion 3*a*, the chambers 21 and 22 constitute the upstream-most side and downstream-most side with regard to the heat exchange medium flow and, as shown in FIGS. 2(*a*) and 2(*b*), the chambers 21 and 22 are made to communicate respectively with an inflow-side passage 25 and an outflow-side passage 26 at the side tank 10 via openings 23 and 24 formed at the tank 3.

Figure 3:
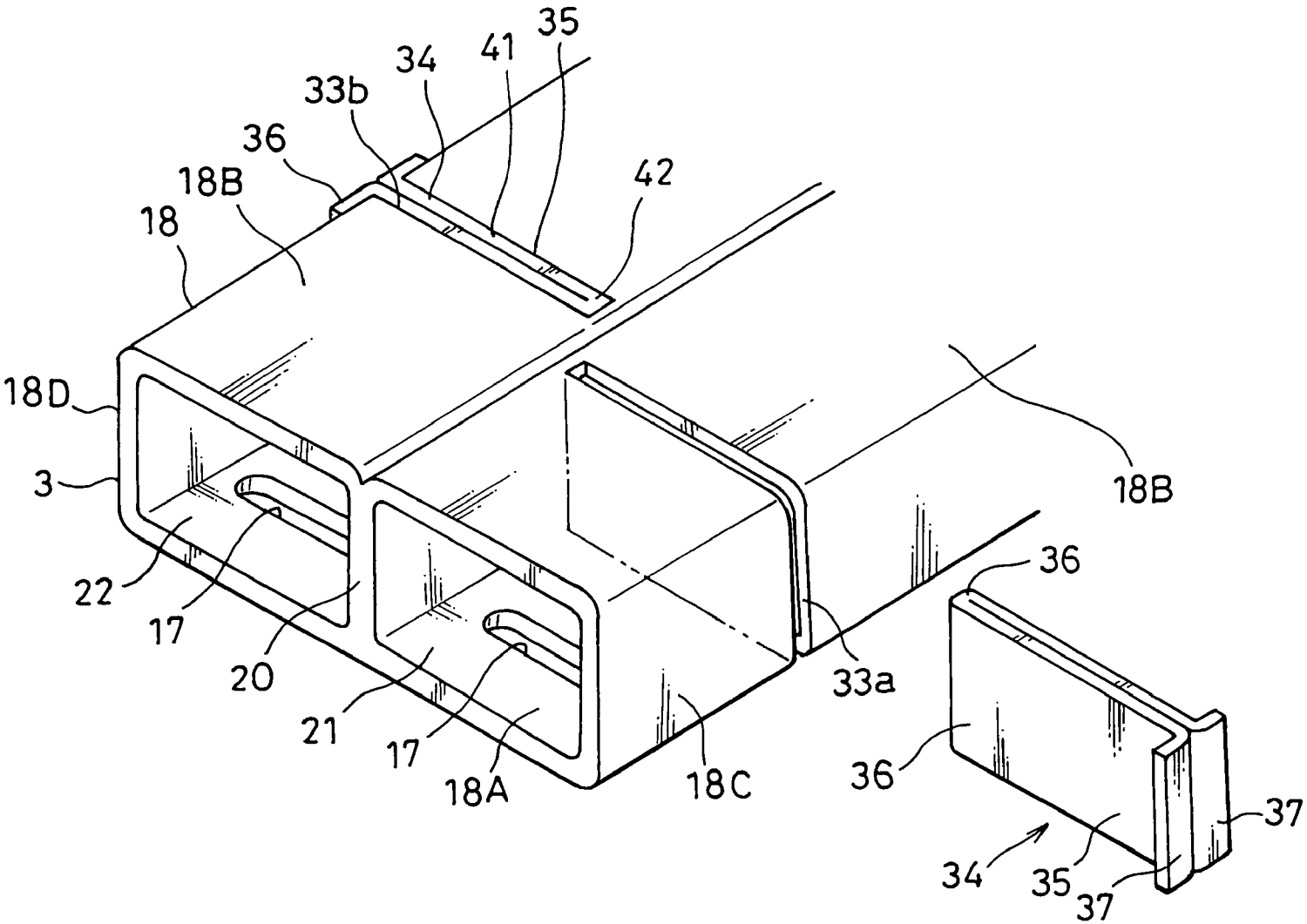
FIG. 3 illustrates the process through which a partition plate is inserted through a slit at the tank in the heat exchanger.
Figure 4:
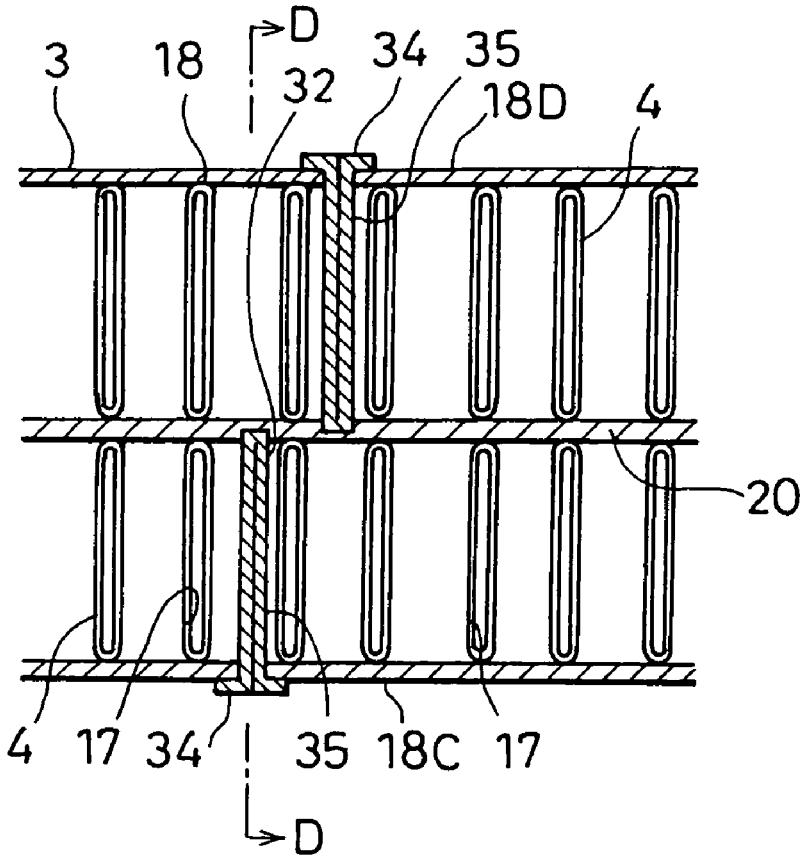
FIG. 4 is a sectional view taken along line C—C in FIG. 5.
Figure 5:
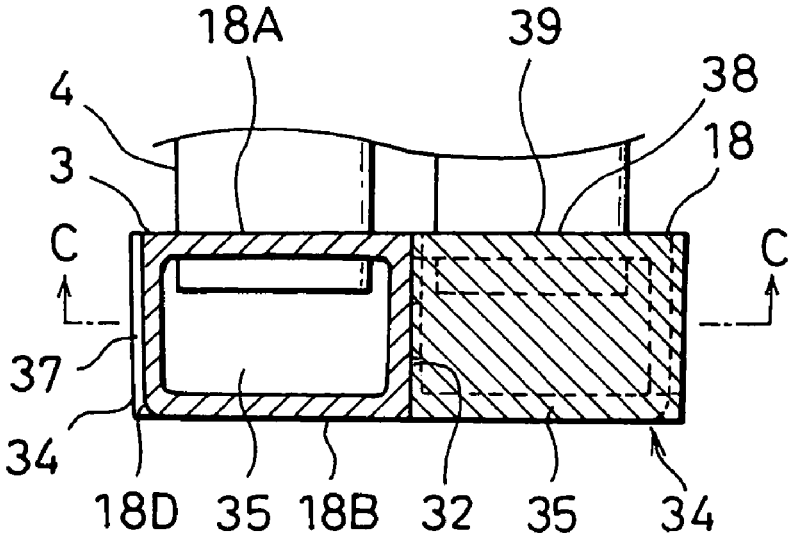
FIG. 5 is a sectional view taken along line D—D in FIG. 4.

To explain how the chambers 21 and 22 at the tank 3 are each divided into sub-chambers 21*a* and 21*b* or sub-chambers 22*a* and 22*b*, the individual chambers are further partitioned into the sub-chambers by inserting and mounting partition plates 34 provided as separate components from the tubular body 18 at slits 33*a* and 33*b* formed at the tubular body 18 of the tank 3, as illustrated in FIGS. 3 through 5.

As shown in FIGS. 1(*a*), 2(*a*) and 3, the slits 33*a* and 33*b* are each formed to run over all the surfaces 18A, 18C and 18B or 18A, 18D and 18B constituting the side faces of the chamber 21 or the chamber 22 at a substantial center on the side extending along the direction in which the tubes are layered. Namely, the slits 33*a* and 33*b* assume a substantially U-shape with the portion of the partitioning wall 20 ranging along the tank width left intact. These slits 33*a* and 33*b* are formed during the process of manufacturing the tank 3 by cutting through the surfaces 18A, 18B, 18C and 18D while notching the partitioning wall 20 with a tool such as a circular saw. The notches formed at the partitioning wall 20 constitute groove portions 32 at which the insertion ends of the partition plates 34 are fitted.

By forming the slits 33*a* and 33*b* so as to run over all the side faces 18A, 18C and 18B and 18A, 18D and 18B in correspondence to the chambers 21 and 22 respectively, as described above, any bypass leakage of the heat exchange medium occurring between the sub-chambers 21*a* and 21*b* or between the sub-chambers 22*a* and 22*b* due to defective bonding of the partition plate 34 can be detected in advance as a pneumatic leak through an inspection of the tank 3 conducted by using He or the like. In addition, the partition plates 34 are bonded to the partitioning wall 25 by fitting the partition plates 34 at the groove portions 32. Since this makes it possible to detect in advance any bypass leakage and thus take measures to prevent such bypass leakage, a highly effective prevention of heat exchange medium bypass leakage is assured in the areas between the sub-chambers 21*a* and 21*b* and between the sub-chambers 22*a* and 22*b*.

In the embodiment, the partition plates 34 are each constituted with plate portions 35 and 35 assuming an external shape substantially identical to the internal contour of the chamber 21 or 22 but having a slightly greater width so as to contact the inner edge inside the opening of the slit 33*a* or 33*b*, two turn portions 36 and 36 connecting the insertion-side ends of the plate portions 35 and 35 with each other and upright portions 37 and 37 rising along the length of the tank from the ends on the side opposite from the ends at which the turn portions 36 are located.

The turn portions 36 have elasticity so as to spring back when an external pressing force is applied on the two sides. As a result, after the partition plate 34 is inserted at the slits 33*a* or 33*b* with the plate portions 35 and 35 pressed on the two sides from the outside, the turn portions 36 recover the original state through repulsion as the pressure on the plate portions 35 and 35 is released. Since this structure allows the outer side surfaces of the plate portions 35 to press against the inner surfaces within the opening of the slits 33*a* and 33*b* in close contact, bypass leakage of the heat exchange medium between the sub-chambers 21*a* and 21*b* and between the sub-chambers 22*a* and 22*b* is prevented with an even higher level of effectiveness. Moreover, since the total width matching the sum of the thicknesses of the plate portions 35 and 35 does not need to be exactly equal to the width of the slit 33*a* and the slit 33*b*, an added advantage is achieved in that excessively rigorous control of the dimensional accuracy with regard to the plate portion thicknesses is not required.

Figure 6:
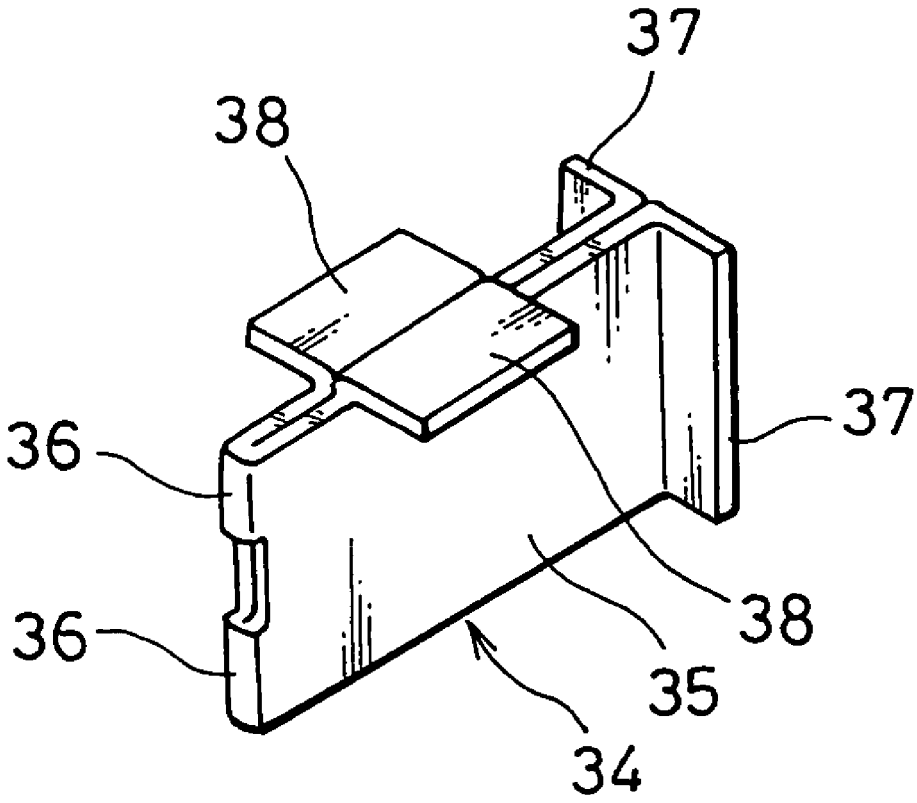
FIG. 6 shows an example of a variation of the partition plate shown in FIG. 3.

The partition plates in the embodiment may instead adopt a structure having upright portions 38 each extending toward one end of the layered tube assembly from a plate portion 35, as shown in FIG. 6. These upright portions 38 will function as guides when the partition plates 34 are inserted through the slits 33*a* and 33*b*, and thus, the partition plates 34 are not allowed to fall through the slits 33*a* and 33*b* prior to the brazing process.

Figure 7:
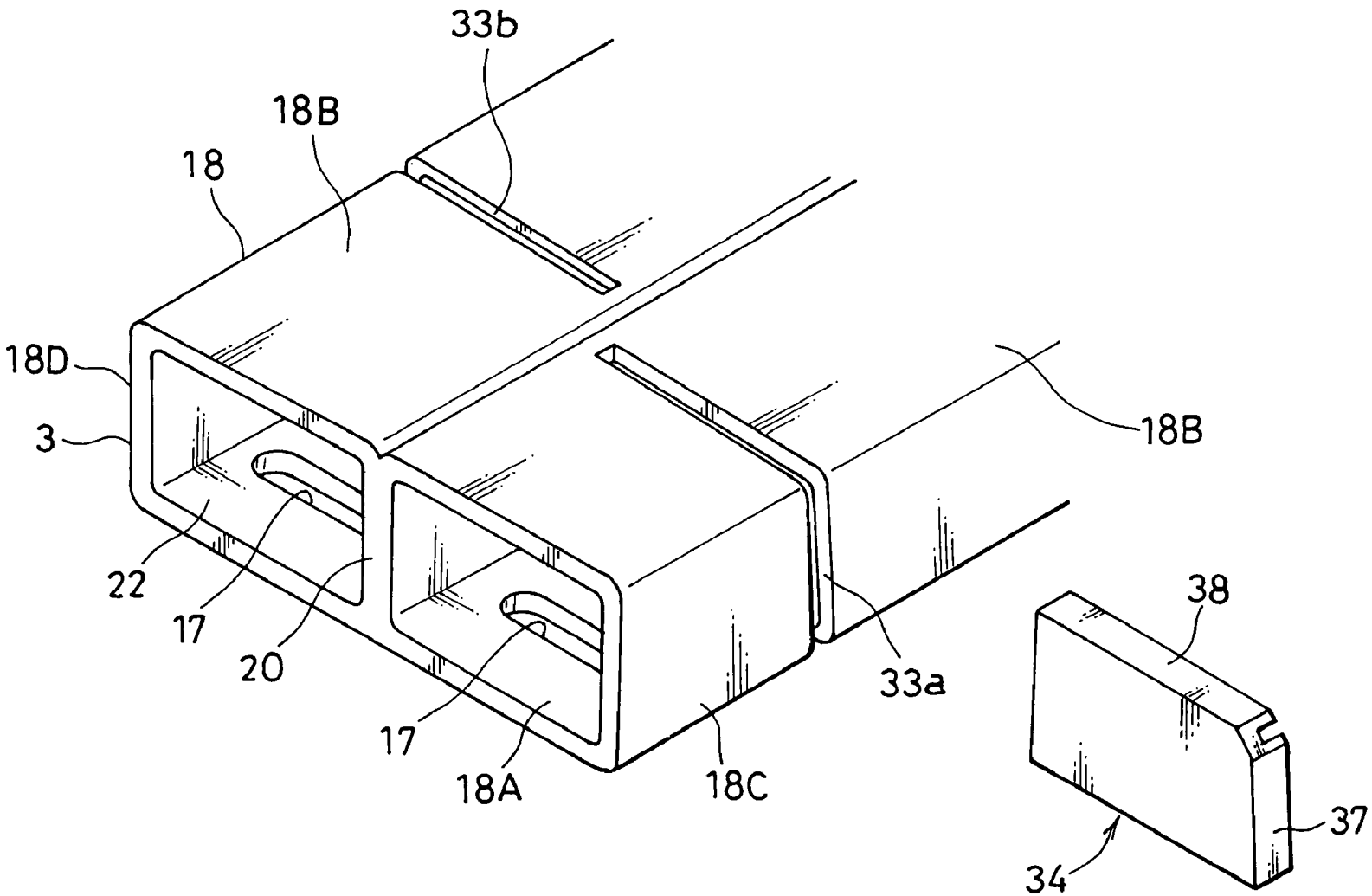
FIG. 7 shows the structure of a partition plate achieved in a second embodiment of the present invention and the process through which the partition plate in the second embodiment is inserted through a slit at the tank.

It is to be noted that the partition plates 34 may adopt structures other than those shown in FIG. 3 and the like. For instance, they may each be constituted with a single plate portion 35 and upright portions 37 and 38 rising from the plate portion 35 toward one end along the length of the tank, as shown in FIG. 7.

Figure 8:
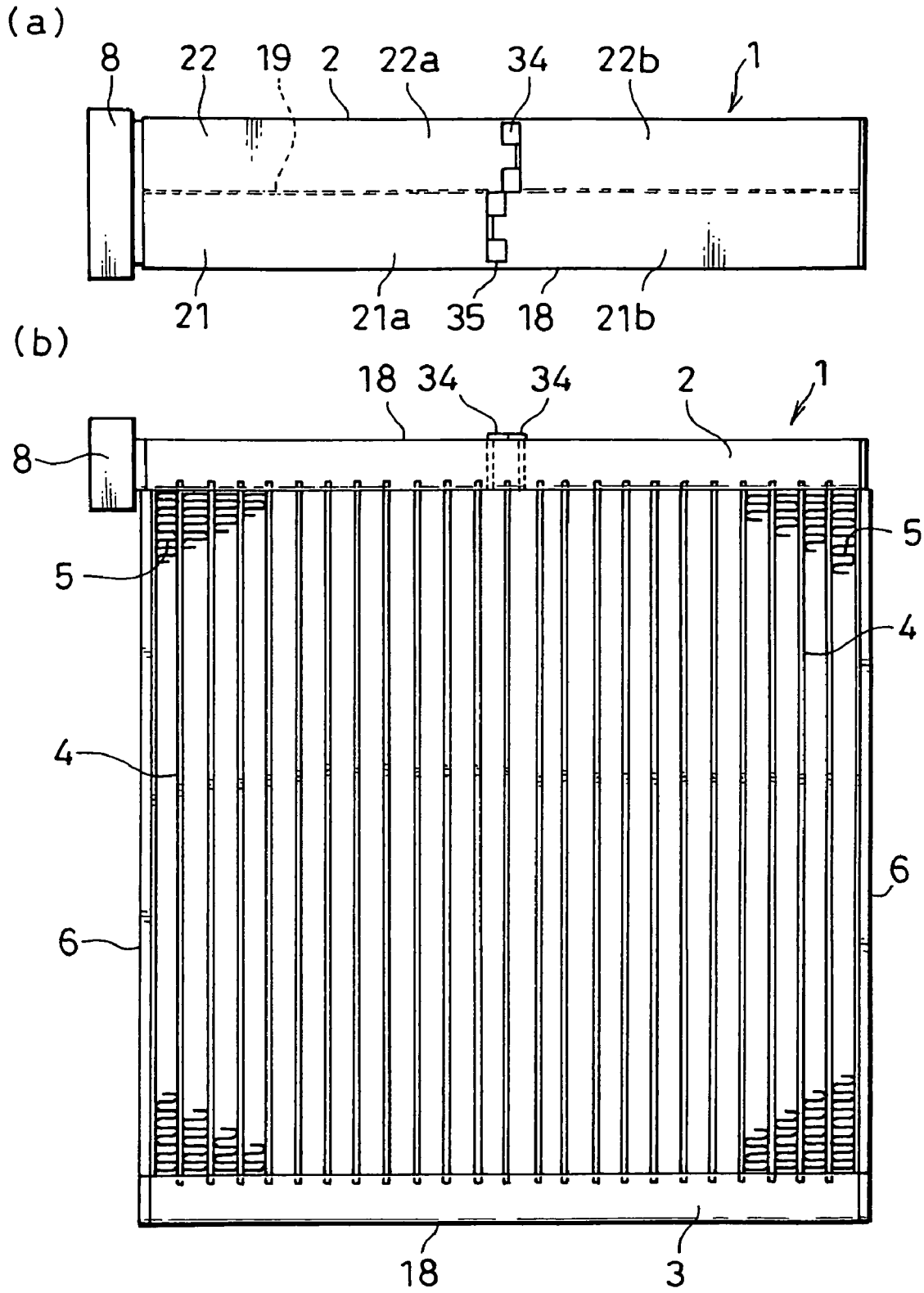
FIG. 8(*a*) is a plan view of the overall structure adopted in a heat exchanger having the partitioning members achieved in the second embodiment and FIG. 8(*b*) is a front view of the overall structure of the heat exchanger.

While a heat exchanger 1 in FIG. 8 is similar to the heat exchanger 1 shown in FIGS. 1 and 2 in that it is used as an evaporator constituting part of a freezing cycle in an on-vehicle air-conditioning system and that it comprises heat exchanging tubes 4, corrugated outer fins 5 inserted and bonded between the individual heat exchanging tubes 4 and side plates 6 disposed at the two ends of the layered assembly of the heat exchanging tubes 4, it differs from the heat exchanger in FIGS. 1 and 2 in that it includes a connector 9 directly disposed at one end of the tank 2 along the lengthwise direction with no side tank 10 provided between them. Accordingly, its tank 2 and tank 3 assume structures different from those of the tanks 2 and 3 of the heat exchanger 1 in the previous embodiment, as detailed below.

Namely, while the tanks 2 and 3 are similar to the tanks in the previous embodiments in that they each include a partitioning wall 19 ranging along the direction in which the heat exchanging tubes 4 are layered, the tank 3 does not have a projecting portion 3*a* and has a lengthwise measurement substantially equal to that of the tank 2. In addition, slits 33*a* and 33*b* are formed at the tubular body 18 of the tank 2 instead of the tank 3, as shown in FIG. 8.

Figure 9:
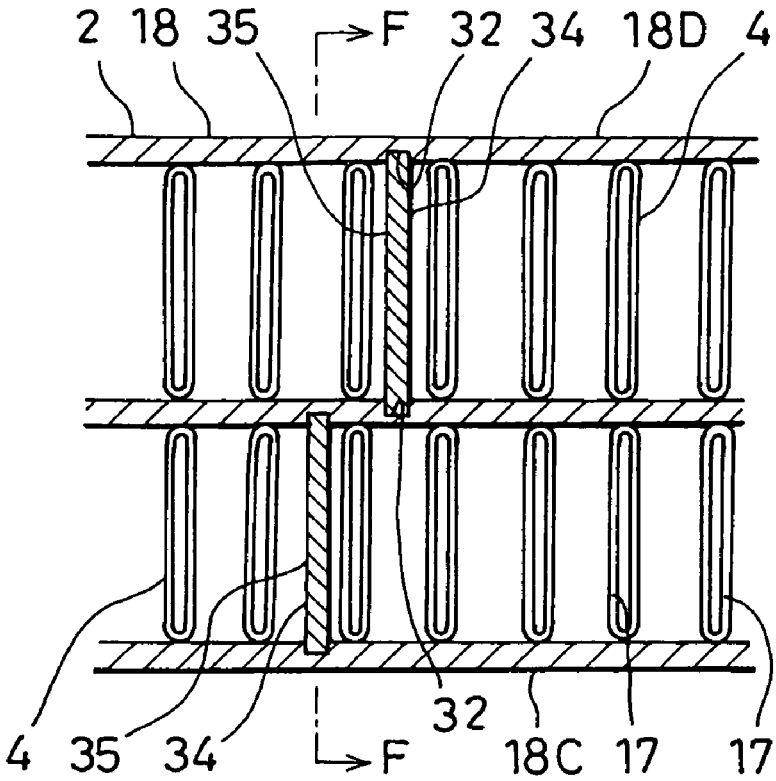
FIG. 9 illustrates the process through which the partition plates are inserted through slits at the tank in the heat exchanger.
Figure 10:
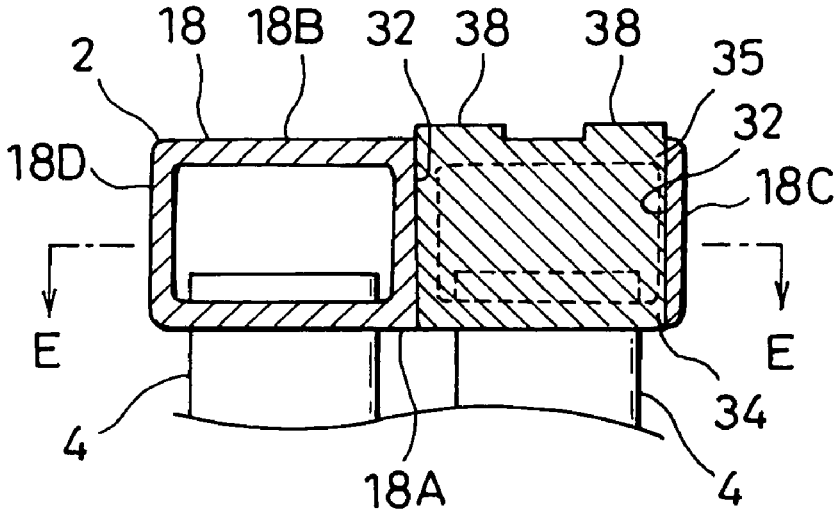
FIG. 10 is a sectional view taken along line E—E in FIG. 11.
Figure 11:
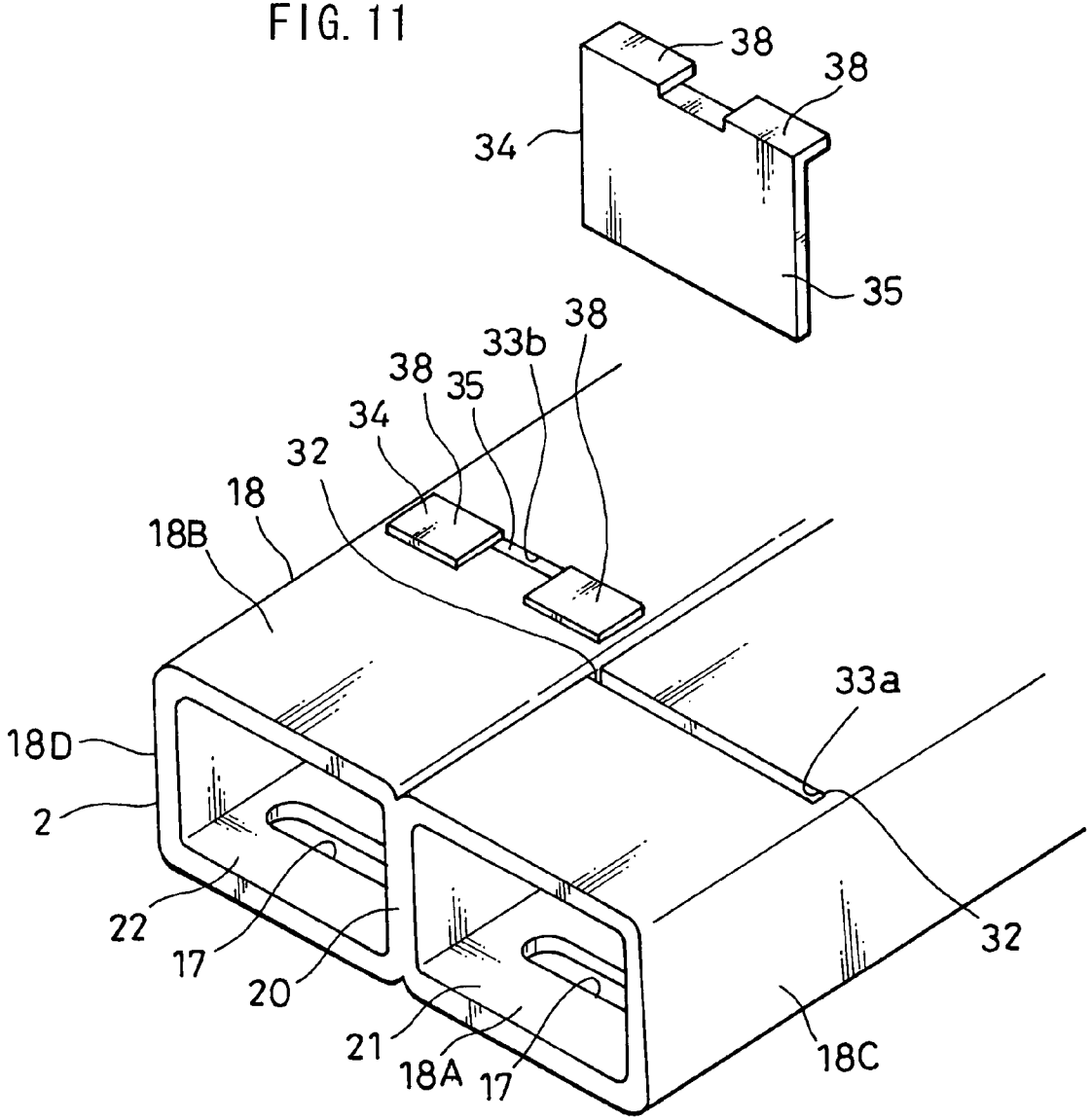
FIG. 11 is a sectional view taken along line F—F in FIG. 10.

The slits 33*a* and 33*b* each include holes surrounded by edges on the four sides and opening at the surfaces 18A and 18B to face opposite each other at a substantial center of the corresponding chamber on the side extending along the direction in which the tubes are layered with the surfaces 18C and 18D both left as solid walls and groove portions 32 and 32 formed by notching the walls at the surfaces 18C and 18D and the partitioning wall 20, as shown in FIGS. 9, 10 and 11.

The partition plates 34 in the embodiment are each constituted with a plate portion 35 and two holding pieces 38. While the plate portion 35 assumes an external shape substantially matching the shape of the opening at the corresponding slits 33*a* or 33*b* and also substantially identical to the shape of the internal section of the corresponding chamber 21 or 22 so as to assure full contact with the inner edges of the openings of the slits 33*a* or 33*b*, its width along the shorter side is slightly increased in correspondence to the depths of the groove portions 32. The holding pieces 38 extend from the plate portion 35 so as to lie along the length of the tank 3 when the partition plate is mounted through the slits 33*a* or 33*b*. In this embodiment, the holding pieces 38 of one partition plate 34 and the holding pieces 38 of the other partition plate 34 are set so as to face toward the center of the layered tube assembly from opposite directions while partially overlapping each other viewed from the direction of the air flow, as shown in FIG. 8(*a*).

By forming the slits 33*a* and 33*b* each as holes each surrounded by edges at the four sides and facing opposite each other at the surfaces 18B and 18B at the individual chambers 21 and 22 and leaving the surfaces 18*c* and 18*d* as solid walls, the partition plates 34 can be mounted and positioned with ease to facilitate the process of fitting the partition plates at the tank.

It is to be noted that in the illustrations of the embodiment presented in FIGS. 8 through 11, the same reference numerals are assigned to components similar to those in the preceding embodiments to preclude the necessity for a repeated explanation thereof.

INDUSTRIAL APPLICABILITY

As described above, according to the present invention, a slit formed at the side faces to insert a partition plates to partition each chamber runs over all the side faces of the chamber or it is constituted as holes at two side faces facing opposite each other and ranging along the air flow direction among the side faces of the chamber. As a result, the partition plate achieves a relationship to the tank wall surfaces that allows any bypass leakage of the heat exchange medium occurring between the sub-chambers due to defective bonding to be detected in advance as a pneumatic leak through an inspection conducted by using He or the like. Since the partition plate is fitted at the groove portion of the partitioning wall, bypass leakage of the heat exchange medium over the area where the partitioning wall and the partition plate are connected with each other is prevented. This structure guarantees that any bypass leakage of the heat exchange medium between the sub-chambers can be prevented with a high degree of reliability.

In particular, according to the present invention disclosed in claim 2, in which the side face ranging perpendicular to the air flow direction is left as a solid wall, the partition plate can be mounted and positioned through the slits with ease to facilitate the process of fitting the partition plate at the tank.

According to the present invention as disclosed in claim 4, after the partition plate with the plate portions deformed toward the inside by applying pressure from the outside is inserted, a spring back occurs at the turn portions as the pressure is released, which presses the plate portions in contact with the opening edges of the slits. Leakage of the heat exchange medium is thus minimized. In addition, since the combined thickness of the plate portions at the partition plate does not need to be set exactly equal to the width of the slits along the air flow direction, the dimensional accuracy of the thicknesses of the individual plate portions constituting the partition plate does not need to be controlled rigorously.

Furthermore, according to the present invention disclosed in claim 5, the required strength of the tank can be assured with greater ease by forming the slits at positions offset from each other over areas where tube insertion holes are not present rather than forming slits in alignment with each other on a single straight line. Namely, since this structure assures a greater thickness for the partitioning wall compared to a structure in which groove portions are formed so as to abut each other at the partitioning wall, the tank is allowed to maintain the required strength with greater ease.

What is claimed is:

1. A tank for a heat exchanger having a tubular body formed through extrusion molding with the inner space thereof partitioned into a plurality of chambers with a partitioning wall extending along the direction in which heat exchanging tubes are layered and tube insertion holes through which open ends of said heat exchanging tubes are inserted formed at side faces of the individual chambers at said tubular body, a slit is formed to open at a side face ranging along the air flow direction and facing opposite the side on which said tube insertion holes are formed among the side faces of each of said chambers;

groove portions at which a partition plate for partitioning said chamber along the length of said tank is fitted, are formed at said partitioning wall and the side face perpendicular to the air flow direction among the side faces at positions corresponding to the position of said slits; and wherein said each chamber is divided into a plurality of sub-chambers by inserting said partition plate through said slit.

2. A tank for a heat exchanger according to claim 1, wherein said partition plate is constituted with a plate portion for blocking said chamber and an upright portion each rising from an end of said plate portion and allowed to come into contact with an edge of said slits.

3. A tank for a heat exchanger according to claim 2, wherein said slit formed in one of said chambers is offset from said slit formed at the other, adjacent chamber along the direction in which said heat exchanging tubes are layered.

4. A tank for a heat exchanger according to claim 1, wherein said slit formed in one of said chambers is offset from said slit formed at the other, adjacent chamber along the direction in which said heat exchanging tubes are layered.

* * * * *